United States Patent [19]

David

[11] 4,427,558

[45] Jan. 24, 1984

[54] FABRIC CONDITIONING MATERIALS

[75] Inventor: John G. David, Wirral, England

[73] Assignee: Lever Brothers Company, New York, N.Y.

[21] Appl. No.: 371,645

[22] Filed: Apr. 26, 1982

[30] Foreign Application Priority Data

May 8, 1981 [GB] United Kingdom ..... 8114134

[51] Int. Cl.[3] ..... D06M 13/40; D06M 13/46

[52] U.S. Cl. ..... 252/8.8; 252/8.75; 252/528; 252/547

[58] Field of Search ..... 252/8.75, 8.8, 8.9, 252/8.6, 528, 547

[56] References Cited

U.S. PATENT DOCUMENTS

| | | | |
|---|---|---|---|
| 2,940,816 | 6/1960 | Sniegowski | 252/8.75 |
| 3,256,180 | 6/1966 | Weiss . | |
| 3,351,483 | 11/1976 | Miner . | |
| 3,356,526 | 12/1967 | Waldman et al. | 252/8.8 |
| 3,686,025 | 8/1972 | Morton . | |
| 3,795,610 | 3/1974 | Eckert et al. | 252/8.8 |
| 3,886,075 | 5/1975 | Bernardino | 252/8.75 |
| 3,920,563 | 11/1975 | Wixon | 252/8.75 |
| 3,920,565 | 11/1975 | Morton | 252/8.75 |
| 3,936,537 | 2/1976 | Baskerville, Jr. et al. . | |
| 3,993,573 | 11/1976 | Gloss . | |
| 4,139,479 | 2/1979 | Goffinet et al. | 252/8.8 |
| 4,141,841 | 2/1979 | McDanald . | |
| 4,173,539 | 11/1979 | Rule et al. | 252/8.8 |

FOREIGN PATENT DOCUMENTS

| | | |
|---|---|---|
| 1315 | 4/1979 | European Pat. Off. . |
| 11333 | 5/1980 | European Pat. Off. . |
| 2454465 | 5/1976 | Fed. Rep. of Germany . |
| 1052847 | 12/1966 | United Kingdom . |
| 1104441 | 2/1968 | United Kingdom . |
| 1313697 | 4/1973 | United Kingdom . |
| 1408787 | 10/1975 | United Kingdom . |
| 1427601 | 3/1976 | United Kingdom . |
| 1597513 | 9/1981 | United Kingdom . |

*Primary Examiner*—P. E. Willis, Jr.

*Attorney, Agent, or Firm*—Milton L. Honig; James J. Farrell

[57] ABSTRACT

Particles for softening fabrics either in a wash liquor or in the rinse, are formed from a liquid mixture comprising water, a cationic material, such as a quaternary ammonium compound, urea and a calcium soap. The particles are formed from the liquid mixture by cooling to a solid and then grinding or by spray cooling. Weathering to form a crisp free flowing powder is optional. The presence of water in the liquid mixture improves the processing of the particles.

7 Claims, No Drawings

FABRIC CONDITIONING MATERIALS

TECHNICAL FIELD

This invention relates to fabric conditioning materials and particularly, but not exclusively, to fabric rinse conditioners, detergent compositions or wash addable, detergent compatible compositions which in addition to cleaning effectiveness also have fabric softening properties.

BACKGROUND ART

Various quaternary ammonium compounds are known in the art to possess fabric softening properties. These quaternary ammonium compounds, and other cationic fabric softening compounds are also known to be generally incompatible with anionic surfactants commonly employed in laundering compositions. The anionic surfactants attack and inactivate the quaternary ammonium compounds in the wash water environment. Thus larger amounts than desired of the fairly expensive quaternary ammonium compounds must be added to detergent compositions to provide a softening effect but this would result in total inactivation of the anionic active. For this reason, detergent compositions containing both anionic surfactants and cationic fabric softeners have not been commercially successful.

Previous proposals on this subject have repeatedly put forward the hypothesis that, in order to avoid inactivation of the cationic fabric softening compounds it is necessary to prevent these cationic materials from dispersing in the wash liquor.

Thus U.S. Pat. No. 2, 936,537 (Baskerville) teaches the mixing of quaternary ammonium compounds with organic dispersion inhibitors into particles. U.S. Pat. No. 4,141,841 (McDanald) teaches that such particles may be agglomerated with water-soluble neutral or alkaline salts. European patent application EP 1315 (Procter & Gamble) teaches that particles of a cationic softener and a dispersion inhibitor can be embedded in spray dried granules of anionic surfactant and builder.

The solutions proposed above have not proved suitable for line-dried fabrics.

DISCLOSURE OF THE INVENTION

We have now found that, contrary to the teaching of the above mentioned prior disclosures, good softening, particularly of line-dried fabrics, can be obtained from a wash liquor without substantial loss of cleaning effectiveness, or from a rinse liquor, by incorporating the cationic fabric softening compound in a particle which includes certain specified components and which is prepared by a specified method.

Thus according to the invention there is provided a method of producing fabric softening particles comprising the steps of (i) forming a liquid mixture comprising:

(A) from about 4% to about 80% by weight of a cationic fabric conditioning material;

(B) from about 10% to about 90% by weight of urea;

(C) from about 2% to about 50% by weight of water; and (D) from about 1% to about 50% by weight of an alkaline earth metal salt of a fatty acid having from 8 to 30 carbon atoms; and (ii) transforming the liquid mixture so formed into solid particles having a particle size of from about 0.1 to about 2000 microns.

Preferably the particles are formed by a method in which the components are intimately mixed in the liquid, preferably heated state, cooled to form a solid and subsequently ground.

The invention further encompasses a detergent composition containing at least an anionic, nonionic, amphoteric or zwitterionic surface active agent and the above mentioned particles.

The cationic materials used in the particles may be water-soluble or -insoluble and may be selected from any of the cationic (including imidazolinium) compounds listed in U.S. Pat. No. 3,686,025 (Morton) the disclosure of which is incorporated herein by reference. Such materials are well known in the art and include, for example, the quaternary ammonium salts having at least one, preferably two, $C_{10}$–$C_{20}$ fatty alkyl or alkenyl substituent groups, alkyl imidazolinium salts where at least one alkyl group contains a $C_8$–$C_{25}$ carbon "chain"; and the $C_{12}$–$C_{20}$ alkyl or alkenyl pyridinium salts.

Preferred cationic materials herein include the quaternary ammonium salts of the general formula $R^1R^2R^3R^4N^+X$ where groups $R^1$, $R^2$, $R^3$ and $R^4$ are, for example, alkyl or alkenyl and $X^-$ is an anion, eg halide, or metho-sulphate, with chloride or methosulphate being preferred. Especially preferred cationic materials are those wherein $R^1$ and $R^2$ are each $C_{12}$–$C_{20}$ fatty alkyl or alkenyl and $R^3$ and $R^4$ are each $C_1$–$C_4$ alkyl. The fatty alkyl or alkenyl groups can be mixed, ie the mixed $C_{14}$–$C_{18}$ coconutalkyl and mixed $C_{16}$–$C_{18}$ tallow alkyl quaternary compounds. Alkyl groups $R^3$ and $R^4$ are preferably methyl.

Exemplary quaternary fabric softeners herein include di-hardened tallow alkyl dimethyl ammononium chloride, di-hardened tallow alkyl dimethyl ammonium methosulphate and dicoconut alkyl dimethyl ammonium chloride. Mixtures of cationic materials may also be used.

The cationic softener occupies from about 8 to about 70% by weight of the particles, preferably from about 10 to about 50%.

The particles preferably contain from about 40% to about 60% of urea. Increasing the level of urea about 60%, particularly above 90%, brings no significant increase in dispersion rate and is only possible at the expense of the level of fabric conditioning material.

The amount of water in the compositions from which the particles are formed preferably lies in the range of from about 10% to about 20% by weight before weathering. After the formation of the liquid mixture, during the formation of the particles and particularly thereafter, the water content may change due to, for example, loss of water vapour to the atmosphere. This process of allowing the particles to move towards equilibrium with their environment is referred to herein as weathering. The change in water content on weathering depends inter alia on the temperature and relative humidity of the environment. After weathering the particles will generally have a water content from about 2% to about 30% by weight, preferably from 5% to about 15%. It is possible however that the weathered particles will contain substantially no water. Particularly where the composition from which the particles are formed has a high water content, it will be necessary to weather the cooled solid before grinding, more essentially before sieving, to allow the particles to harden. In the case of such high water contents, the nature and content of the other components of the particles should be selected in such a manner as to ensure that the particles are solid.

The particles also contain an alkaline earth metal salt of a fatty acid. Specific examples are calcium soaps such as calcium tallow soap and calcium palmitate.

The amount of calcium soap in the particles before weathering preferably lies between about 1% and about 30% by weight, and the weight ratio of calcium soap to the cationic fabric conditioning material is preferably between about 0.05:1 and about 5.0:1, most preferably between about 0.25:1 and about 0.5:1.

Further, the cationic fabric conditioning material is preferably in molar excess over the calcium soap.

Other components may be present in the particles up to a level of preferably not more than about 76% by weight, most preferably less than about 60% by weight.

These other components may include, for example, nonionic surface active agents, such as alkylene oxide adducts of monoalkyl phenols, dialkyl phenols, fatty alcohols, secondary alcohols, alkyl mercaptans, as well as hydroxyl-containing alkyl sulphides, alkylsulphoxides and alkylsulphones, in which compounds the total number of carbon atoms in the hydrocarbon part is from eight to twenty carbon atoms and the polalkylene glycol chain has from four to forty alkylene groups of from two to four carbon atoms.

The particles may also include a perfume, in particular from about 0.5% to about 5%, more preferably from about 1.5% to about 3% by weight of perfume in the particles.

The particles according to the invention also contain inorganic materials, in particular water-soluble inorganic salts such as alkalimetal chlorides, carbonates, silicates, aluminosilicates, orthophosphates, pyrophosphates, tripolyphosphates, sulphates, borates, perborates and percarbonates.

The particles according to the invention have an average size of between about 0.1 to about 2000 microns, preferably between about 1 and about 1000 microns. Most preferably the particles have an average size of between about 10 and about 500 microns.

The softening particles according to the invention may be incorporated in a detergent compatible wash additive product comprising at least about 2.0% by weight of the particles and optionally a solid carrier medium. In the case of a solid carrier medium this may be comprised by, for example, a synthetic detergent active material or a water-soluble inorganic material such as sodium sulphate, sodium carbonate, sodium perborate or sodium tripolyphosphate.

Alternatively the particles may be incorporated in a detergent composition, either solid or liquid, comprising from about 5% to about 85% by weight of a water-soluble detersive surfactant, with or without a detergency builder, and from about 0.5% to about 30% by weight of the particles. One may also form a rinse conditioner comprising only the particles according to the invention or at least about 1% by weight of the particles optionally together with a solid or liquid diluent medium.

The detersive surfactants and detergency builders which may be used in the compositions of the invention include those listed in "Surface Active Agents and Detergents", Volume I and II by Schwartz, Perry and Berch.

Typical synthetic anionic detergents are the alkyl benzene sulphonates having from 8–16 carbon atoms in the alkyl group, eg sodium dodecyl benzene sulphonate; the aliphatic sulphonates, eg $C_8$–$C_{18}$ alkane sulphonates; the olefin sulphonates having from 10–20 carbon atoms, obtained by reacting an alpha-olefin with gaseous diluted sulphur trioxide and hydrolysing the resulting product; the alkyl sulphates such as tallow alcohol sulphate, and further the sulphonation products of ethoxylated and/or propoxylated fatty alcohols, alkyl phenols with 8–15 carbon atoms in the alkyl group, and fatty acid amines, having 1–8 moles or ethoxylene or propoxylene groups.

Soaps may also be present in the detergent compositions of the invention, but preferably not as the sole detergent compounds. The soaps are particularly useful at low levels in binary and ternary mixtures, together with nonionic or mixed synthetic anionic and nonionic detergent compounds, which have low sudsing properties. The soaps which are used are the sodium, or less desirably potassium, salts of $C_{10}$–$C_{24}$ fatty acids. It is paticularly preferred that the soaps should be based mainly on the longer chain fatty acids within this range, that is with at least half of the soaps having a carbon chain length of 16 or over. This is most conveniently accomplished by using soaps from natural sources such as tallow, palm oil or rapeseed oil, which can be hardened if desired, with lesser amounts of other shorter chain soaps, prepared from nut oils such as coconut oil or palm kernel oil. The amount of such soaps can be up to about 25% by weight, with lower amounts of about 0.5% to about 5% being generally sufficient for lather control. Amounts of soap between about 2% and about 20%, especially between about 5% and about 15%, can advantageously be used to give beneficial effect on detergency and reduced levels of incrustation.

Typical nonionic detergents are the condensation products of alkyl phenols having 5–15 carbon atoms in the alkyl group with ethylene oxide, eg the reaction product of nonyl phenol with 6–30 ethylene oxide units; the condensation products of higher fatty alcohols, with ethylene oxide, known under the Trade Name of "Tergitol"$^R$ supplied by Union Carbide, the condensation products of a fatty acid amide with 8–15 ethylene oxide units and the condensation products of polypropylene glycol with ethylene oxide.

Suitable builders are weakly acid, neutral or alkaline reacting, inorganic or organic compounds, especially inorganic or organic complex-forming substances, eg the bicarbonates, borates or silicates of the alkalimetals; the alkalimetal ortho-, meta-, pyro- and tripolyphosphates. Another class of suitable builders are the insoluble sodium aluminosilicates as described in Belgian Patent No. 814,874.

The compositions according to the invention may also include other ingredients conventionally added to detergent compositions, including bleaches, bleach precursors, optical brightening agents, fillers, buffers, antiredeposition agents, preservatives, antifoaming agents, abrasives, thickeners, enzymes, organic solvents and perfumes.

The particles according to the invention may be prepared by a number of methods. Ideally, the components of the particles are mixed in the hot liquid state, allowed to solidify and then ground to the required size. Thus, for example, one may mix the water and the matrix material and heat until the mixture becomes liquid. The other components of the particle can then be added to the liquid and mixed thoroughly therein. The liquid may then be cooled to eg a solid sheet or to small solid pieces and subsequently ground and sieved to the required size. The solidified mixture may be weathered when necessary for up to about 60 hours before grinding to give a crisp, free flow powder. In the case of some particle compositions grinding to give a crisp free flowing powder may be possible with substantially no weathering. The particles may also be formed by spray cooling the liquid mixture. The components can also be mixed in any other order, eg water and cationic mixed to a hot cream/paste and then matrix material added. The amount of water which is used for processing is determined by the desired final water content before weathering with allowance for the water content of the other components of the particles.

As used herein, the term "liquid" should be taken to cover not only free flowing pourable liquids, but also slurries, pastes and creams.

The invention will now be illustrated by the following Examples, in which the precentages given are by weight unless otherwise specified. The quantities of water specified relate to the proportion of water in the unweathered composition during preparation. The final water content of the particles depended on the degree of weathering.

EXAMPLE 1

A mixture of 3 parts water and 10 parts urea was heated to 70° C.–80° C. to provide a clear liquid. 1 part of Tergitol 15-S-12 (nonionic surfactant) was then added. At this stage the mixture remained liquid. 2 parts of calcium tallow soap was then added followed by 4 parts of Arosurf TA 100 (a cationic softening agent which is approximately distearyl dimethyl ammonium chloride). The mixture was well stirred, then cooled to a solid and weathered for a sufficient time to enable the solid to be ground and sieved to give a powder with a particle size of 180–355μ. Weathering of the solid before grinding was carried out for less than 4 hours. This powder was allowed to weather overnight.

The composition of the particles thus formed was as set out in the following Table 1A.

TABLE 1A

| | % by weight |
|---|---|
| Water | 15 |
| Urea | 50 |
| Dimethyl dihardened tallow ammonium chloride | 20 |
| Ca tallow soap | 10 |
| Tergitol 15-S-12 | 5 |

These particles were incorporated in a detergent composition dispersed in water to form wash liquors having the compositions set out in the following Table 1B, which also lists a control wash liquor.

TABLE 1B

| | % by weight | |
|---|---|---|
| | | CONTROL |
| Ingredient | A | B |
| Particles | 0.075 | |
| (level of cationic in wash liquor) | 0.015 | (0) |
| Tergitol 15-S-12 | 0.04 | .04 |
| Sodium tripolyphosphate | 0.08 | .08 |

Artificially soiled test fabrics were washed in these wash liquors from 15 minutes at 75 opm, rinsed twice in cold water and then line dried. Detergency results are given in the following Table 1C, where Δ R460* is the difference between the reflectance at 460 nm of the test cloths before and after washing as measured on an Elrepho Reflectometer ("Elrepho" is a Trade Mark). The test fabrics used were cotton (X) and polyester/cotton (Y).

TABLE 1C

| Wash liquor | Temperature °C. | Test Fabric | Δ R460* |
|---|---|---|---|
| A | 40 | X | 19.5 |
| B | 40 | X | 19.9 |
| A | 65 | X | 21.3 |
| B | 65 | X | 22.0 |
| A | 65 | Y | 26.1 |
| B | 65 | Y | 24.2 |

From the results given in the above table it is clear that composition which contains particles according to the invention (namely A) does not give significantly poorer detergency results than are achieved with the base composition only (B).

EXAMPLES 2 TO 3

The Examples set out in the following Table 2 were prepared by comelting the ingredients and mixing intimately. On cooling, the solids were ground and sieved to give powders of particle sizes 180–355μ.

TABLE 2

| | % by weight | |
|---|---|---|
| Example No | 2 | 3 |
| Urea | 49 | 49 |
| Water | 14 | 14 |
| Tergitol 15-S-12 | 5 | 5 |
| Dimethyl dihardened tallow ammonium chloride | 24.6 | 20.0 |
| Calcium palmitate | 7.4 | 12.0 |

The particles were then added to a wash liquor containing 0.04% Tergitol 15-S-7 and 0.08% sodium tripolyphosphate to give a cationic concentration of 0.015%. The wash liquor was used to wash fabrics at 40° C. All samples gave better softening than particles consisting only of cationic plus calcium palmitate.

EXAMPLES 4 TO 8

Using the method described in Example 1, particles having the following compositions were prepared. The particle sizes were 180–355μ.

TABLE 3A

| Example No | 4 | 5 | 6 | 7 | 8 |
|---|---|---|---|---|---|
| Urea | 50 | 50 | 50 | 50 | 50 |
| Water | 15 | 15 | 15 | 15 | 15 |
| Dihardened tallow dimethyl ammonium chloride | 25 | 20 | 15 | 10 | 5 |
| Tergitol 15-S-12 | 5 | 5 | 5 | 5 | 5 |
| Ca tallow soap | 5 | 10 | 15 | 20 | 25 |

Softening tests were carried out as described in Example 2 at 40° C. using wash liquor containing 0.04% Tergitol 15-S-12, 0.08% sodium tripolyphosphate and sufficient particles to give 0.015% cationic. Average softening scores were allotted to each composition on a scale of 1–7, the lowest score giving the best results.

The results were as follows:

TABLE 3B

| Example No | Average Softening Score |
|---|---|
| 4 | 2.1 |
| 5 | 1.2 |
| 6 | 3.1 |
| 7 | 5.5 |
| 8 | 5.9 |

EXAMPLE 9

Using the method set out in Example 1, particles were prepared from the following formulation.

| Ingredient | % (by weight) |
|---|---|
| Cationic* | 20 |
| Urea | 50 |
| Water | 15 |
| Nonionic** | 5 |
| Calcium tallow soap | 10 |

*Arosurf TA100 (approximately dihardened tallow dimethyl ammonium chloride)
**Tergitol 15-S-12

The components were mixed at about 80° C., cooled to give a soft solid, weathered for about 12 hours, ground and sieved to give two samples of particles, the first having a particle size between 180 and 355μ and the second having a particle size between 355 and 600μ.

The products were tested for the softening of fabrics from the rinse. Two sets of experiments were carried out, one in a Tergotometer paddle agitator machine and the second in two different types of automatic washing machine. The procedures adopted were as follows.

Tergotometer Tests 1 litre of cold Wirral water was used. The fabric load consisted of four terry towelling test cloths weighing in all 50 g. The test powders were sprinkled into cold water, the test pieces were added immediately and rinsing was carried out with agitation for 2 minutes. The fabrics were then spun dry, line dried and assessed for softness. The results were as follows:

TABLE 4A

| Concentration of particles | Concentration of cationic | Softness scores 180/355μ | 355/600μ |
|---|---|---|---|
| 0.034% | 0.008% | 1.4 | 1.3 |
| 0.025% | 0.006% | 1.8 | 2.0 |
| 0.017% | 0.004% | 2.8 | 2.7 |
| 0 (control) | 0 | 4.0 | 4.0 |

This experiment was then repeated, but including a further control consisting of a 5% dispersion of the same cationic in water. The results were as follows:

TABLE 4B

| Concentration of particles | Concentration of cationic | Softness scores 180/355μ | 355/600μ |
|---|---|---|---|
| 0.034% | 0.008% | 1.1 | 1.1 |
| 0.017% | 0.004% | 2.3 | 2.3 |
| 0.1% (dispersion) | 0.005% | 2.7 | 2.6 |
| 0 (control) | 0 | 4.0 | 4.0 |

The results in Table 4B demonstrate that the powder softens at least as well as an aqueous dispersion of cationic, indicating that it is dispersed well in the cold rinse water over a period of about 2 minutes.

Washing Machine Tests

Two machines were used, a HOOVER front-loading drum machine and a HOTPOINT top-loading paddle agitator machine. The load comprised 2.5 kg mixed clean fabrics. The wash cycle used 100 g PERSIL AUTO detergent in warm water. The powders were added to the final rinse (3rd in HOOVER and 2nd in HOTPOINT), through the dispenser of the HOOVER machine and sprinkled directly into the rinse water in the HOTPOINT. The amount of powder used was equivalent to 2.5 g cationic in the rinse liquor. The fabrics after rinsing were line-dried and then assessed for softness. Two controls were used, one using no softener and one using 50 ml of a 5% aqueous dispersion of the same cationic. The results were as follows:

TABLE 4C

| Treatment | Softness scores HOOVER | HOTPOINT |
|---|---|---|
| Powder | 1.3 | 1.6 |
| Cationic dispersion | 1.7 | 1.4 |
| No softener | 3.0 | 3.0 |

These results demonstrate that the powder softens as well as an aqueous dispersion of the cationic, indicating again that the powder dispersed well in the machine rinse liquor.

I claim:

1. A method of producing fabric softening particles characterised by the steps of (i) forming a liquid mixture comprising:

(A) from about 4% to about 80% by weight of a cationic fabric conditioning material;

(B) from about 10% to about 90% by weight of urea;

(C) from about 2% to about 50% by weight of water; and (D) from about 1% to about 50% by weight of an alkaline earth metal salt of a fatty acid having 8–30 carbon atoms, the weight ratio of fatty acid salt to cationic fabric conditioning material being between about 0.25:1 and about 0.5:1; and (iii) transforming the liquid mixture so formed into solid particles having a particle size of from about 0.1 to about 2000 microns.

2. A method according to claim 1, characterised in that the liquid mixture additionally contains a nonionic surface active agent.

3. Fabric softening particles characterised in that they have been prepared by a method according to claim 1 or 2.

4. Fabric softening particles according to claim 3, characterised by containing from about 2% to about 30% by weight of water.

5. A detergent compatible wash additive product characterized in that it contains at least about 2.0% by weight of the particles claimed in claim 3.

6. A detergent composition comprising from about 5% to about 85% by weight of a water-soluble detersive surfactant, with or without a detergency builder, characterized in that is further contains from about 0.5% to about 30% by weight of the particles claimed in claim 3.

7. A rinse conditioner characterized by comprising at least about 1% by weight of the particles claimed in claim 3.

* * * * *